US005952635A

United States Patent [19]

Plat et al.

[11] Patent Number: 5,952,635

[45] Date of Patent: Sep. 14, 1999

[54] GENERATOR CIRCUIT BREAKER

[75] Inventors: Jean-Michel Plat, Estrablin; Jean-Marc Willieme, La Mulatiere, both of France

[73] Assignee: GEC Alsthom T & D SA, Paris, France

[21] Appl. No.: 09/078,519

[22] Filed: May 14, 1998

[30] Foreign Application Priority Data

May 15, 1997 [FR] France ..... 97 05983

[51] Int. Cl.[6] ..... H01H 33/18; H01H 33/70; H01H 33/82

[52] U.S. Cl. ..... 218/43; 218/154; 218/118; 218/78

[58] Field of Search ..... 218/43, 45, 48, 218/49, 50, 52, 65, 69, 70, 74, 118, 120, 121, 123, 124, 125, 126, 140, 146, 154

[56] References Cited

U.S. PATENT DOCUMENTS 3,399,286 8/1968 Kerr, Jr. .
4,559,424 12/1985 Lorenz et al. ..... 200/146 R
5,495,084 2/1996 Meyer et al. ..... 218/43

FOREIGN PATENT DOCUMENTS 0 412 479 2/1991 European Pat. Off. .
2 189 916 1/1974 France .
34 07 858 8/1984 Germany .

*Primary Examiner*—Lincoln Donovan
*Attorney, Agent, or Firm*—Sughrue, Mion, Zinn, Macpeak & Seas, PLLC

[57] ABSTRACT

The generator circuit breaker includes synchronization means for separating its main contacts before its arcing contacts are separated. It has a lever which is hinged at one of its ends to a fixed contact piece and which is constrained to move firstly with the moving main contact and secondly with the moving arcing contact by means of a spring, and with a ramp having two horizontal levels interconnected by a sloping intermediate portion, the ramp serving as a sliding support for a trigger member which prevents or authorizes movement of the moving arcing contact. This organization makes it possible for the moving contacts to be synchronized mechanically in simple and single manner.

12 Claims, 3 Drawing Sheets

GENERATOR CIRCUIT BREAKER

FIELD OF THE INVENTION

The invention relates to a generator circuit breaker comprising a fixed tubular main contact and a moving tubular main contact that moves relative to the fixed tubular main contact in a "longitudinal" direction, the main contacts defining a volume within which there is disposed a vacuum or gas "bottle" having a fixed arcing contact and a moving arcing contact which moves relative to the fixed arcing contact in said longitudinal direction, synchronization means serving to separate the main contacts before the arcing contacts separate.

BACKGROUND OF THE INVENTION

Such a circuit breaker is usually placed between a generator in an electricity power station and a transformer connected to a power transport line.

In known manner, the main contacts are sufficiently massive to be capable of withstanding high nominal currents without heating up excessively. They define a relatively large volume which is more difficult to put under gas pressure or into a vacuum than is a "bottle" of small size placed inside said volume. The bottle has a fixed arcing contact and a moving arcing contact which are less massive since they do not have to withstand the breaking current of the circuit breaker.

In French patent application FR 89/13279, the moving main contact and moving arcing contact extend in a common longitudinal direction, and are moved in translation parallel to said direction by pneumatic means having pistons and cylinders.

Those means are not without their drawbacks.

Firstly, it is necessary to provide electrically controlled valves to synchronize the displacements of the pneumatic actuators for the moving main contact and for the moving arcing contact. In particular, the moving main contact must accomplish sufficient displacement to withstand a transient electrical voltage prior to the moving arcing contact opening.

Secondly, at the end of the stroke of the moving arcing contact, it is not possible to obtain acceleration that is satisfactory, enabling the circuit breaker to open with great efficiency, unless relatively sophisticated apparatus is used for feeding gas to the pneumatic actuators.

OBJECTS AND SUMMARY OF THE INVENTION

The object of the invention is to provide a generator circuit breaker in which the moving contacts are actuated by a small number of mechanical means that are synchronized in simple manner.

To this end, the invention provides a generator circuit breaker comprising a fixed tubular main contact and a moving tubular main contact that moves relative to the fixed tubular main contact in a "longitudinal" direction, the main contacts defining a volume within which there is disposed a vacuum or gas "bottle" having a fixed arcing contact and a moving arcing contact which moves relative to the fixed arcing contact in said longitudinal direction, synchronization means serving to separate the main contacts before the arcing contacts separate, wherein the synchronization means comprise a lever which is hinged at one of its ends to a fixed contact piece and which is constrained firstly to move with the moving main contact and secondly to move with the moving arcing contact by means of a spring, and a ramp having two horizontal levels interconnected by a sloping intermediate portion, the ramp serving as a sliding support for a trigger member, which trigger member prevents the moving arcing contact from moving while said trigger member is sliding on one of the horizontal levels of the ramp, and releases the moving arcing contact to move by engaging the sloping intermediate portion and while sliding over the other horizontal level of the ramp.

The invention also provides a generator circuit breaker comprising a fixed tubular main contact and a moving tubular main contact that moves relative to the fixed tubular main contact in a "longitudinal" direction, the main contacts defining a volume within which there is disposed a vacuum or gas "bottle" having a fixed arcing contact and a moving arcing contact which moves relative to the fixed arcing contact in said longitudinal direction, synchronization means serving to separate the main contacts before the arcing contacts separate, wherein the synchronization means comprises a lever which is hinged at one of its ends to a fixed contact piece and which is constrained firstly to move with the moving arcing contact and secondly to move with the moving main contact by means of a wheel guided in a groove formed in the moving main contact and having two horizontal levels interconnected by a sloping intermediate portion, movement of the moving main contact, when the wheel is guided by the inclined intermediate portion of the groove, entraining movement of the moving arcing contact by pivoting the lever.

The lever common to the two moving contacts of the circuit breaker of the invention makes it possible to move them in translation using a single mechanical control, thereby reducing the number of means that need to be implemented to move them.

Movement of the moving main contact is synchronized relative to movement of the moving arcing contact in simple manner using a ramp or a groove having two horizontal levels that are interconnected by a sloping intermediate portion. The arcing contacts open only under drive from the sloping intermediate portion. They make it possible to establish a distance between the main contacts that is sufficient to withstand a transient electric voltage prior to the arcing contacts opening.

BRIEF DESCRIPTION OF THE DRAWINGS

Other characteristics and advantages of the invention appear on reading the following description of two embodiments shown in the drawings.

MORE DETAILED DESCRIPTION

Figure 1:
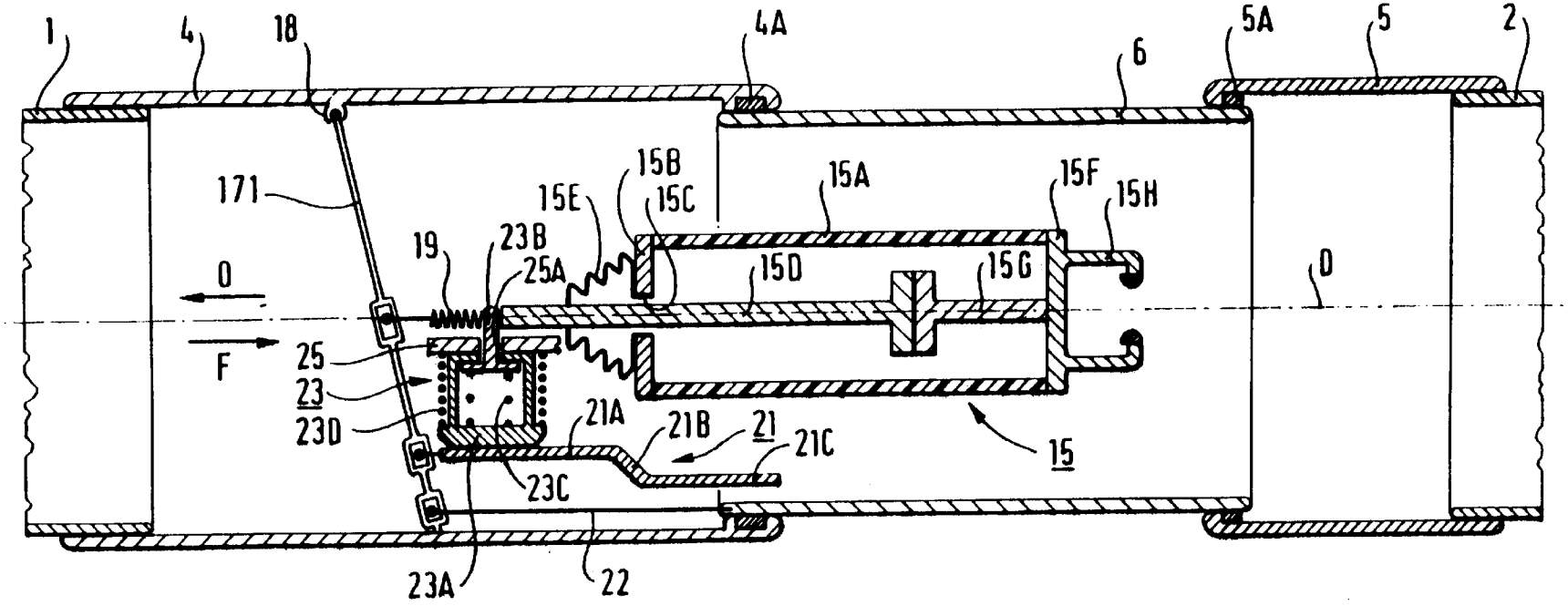
FIG. 1 is a diagrammatic longitudinal section view of a circuit breaker including a ramp and a trigger member.

In FIG. 1, the circuit breaker of the invention is inserted between portions 1 and 2 of a phase conductor of an electricity line. Portions 1 and 2 of the conductor are connected mechanically and electrically to a fixed main contact 5 and to a fixed contact piece 4 of the circuit breaker. These contacts co-operate with a main contact 6 that is movable relative thereto in a longitudinal direction D. Co-operation between the fixed main contact 5 and the moving main contact 6 is provided by a ring of contact fingers 5A. A sliding contact 4A provides co-operation between the fixed contact piece 4 and the moving main contact 6.

The fixed main contact 5, the fixed contact piece 4, and the moving main contact 6 are all tubular in shape, defining an inside volume in which there is located a "bottle" 15 that is evacuated or that contains a gas such as sulfur hexafluoride $SF_6$. This bottle has a cylindrical 30 insulating envelope 15A provided with a metal end wall 15B having a central hole 15C through which a moving arcing contact 15D slides. The bottle is held in a fixed position in the volume by arms that are not shown but that are fixed to its end wall 15B. The central hole of the bottle is sealed by means of a bellows 15E.

Since the vacuum or the gas is restricted to inside the bottle, the pressure that surrounds between the main contacts is preferably equal to atmospheric pressure.

The bottle is closed at its end opposite to the end wall 15B by a metal end wall 15F carrying a fixed arcing contact 15G mounted inside the bottle, and a ring of metal contact fingers 15H mounted outside the bottle.

The moving main contact 6 is secured to a lever 171 via a rigid rod 22. One end of the lever 171 is hinged about a pivot 18 secured to the fixed contact piece 4. The moving arcing contact 15D is connected to the same lever 171 via a spring 19.

A ramp 21 having two horizontal levels 21A and 21C interconnected by a sloping intermediate portion 21B has one of its ends secured to the lever 171.

A trigger member 23, comprising a frame 23A housing a retractable catch 23B mounted on a spring 23C and movable in translation perpendicularly to the longitudinal direction D through a hole 25A formed in a fixed plane 25 inside the volume of the circuit breaker slides on the ramp 21 and is held in contact with the ramp under drive from a spring 23D compressed between the ramp 21 and the fixed plane 25.

A single control (not shown) serves to move the main contact 6 in translation along direction D. It is also possible to rotate the lever 171 using the control.

The circuit breaker described above operates as follows:

On opening, the translation movement of the moving main contact 6 in direction D along arrow O acts via the rod 22 and the lever 171 to move the ramp 21 in translation, which is accompanied by the frame 23A sliding along the horizontal level 21A of the ramp. The projecting position of the catch 23B which results from the combined action of the spring 23C and of the spring 23D prevents the moving arcing contact 15D from moving in translation on direction D, and causes the spring 19 to be extended.

The moving main contact 6 travels along a fraction of its opening stroke that corresponds to being at a distance from the fixed main contact 5 that is sufficient, in air, to withstand a transient electrical voltage applied to the circuit breaker. Once this distance has been travelled, the frame 23A engages the sloping intermediate portion 21B of the ramp, and then travels along horizontal level 21C of the ramp, under drive from the spring 23D. The offset between the two horizontal levels of the ramp 21 enables the catch 23B to be withdrawn from the moving arcing contact 15D, which is then released and moves quickly in translation under drive from the spring 19.

On closing, movement of the moving main contact 6 in translation on direction D along arrow F acts via the rod 22 and the lever 171 to move the ramp 21 and the moving arcing contact 15D in translation. The frame 23A slides over the horizontal level 21C of the ramp, engages the sloping intermediate portion 21B, and moves to horizontal level 21A. Once the moving arcing contact 15D and the fixed arcing contact 15G have come into contact, the catch 23B projects from the fixed plane 25 under the combined action of springs 23C and 23D. Thereafter, the moving main contact 6 completes its closure stroke. The additional stroke of the moving main contact 6 compared with the moving arcing contact 15D causes the spring 19 to be compressed.

In this particular embodiment, the circuit breaker has several advantages.

Firstly, the speed in translation of the moving main contact 6 is relatively slow, which given the massive nature of its parts, makes it possible to reduce the mechanical power required to control movement thereof. In addition, the translation movement of the moving arcing contact 15D is relatively fast, thus making it possible to minimize the exposure of the arcing contacts to the interruption current.

Furthermore, the distance required in air for withstanding the transient voltage between the main contacts is determined, as a function of the nominal voltage of the electricity line, by the lengths of the horizontal levels of the ramp.

Figure 2:
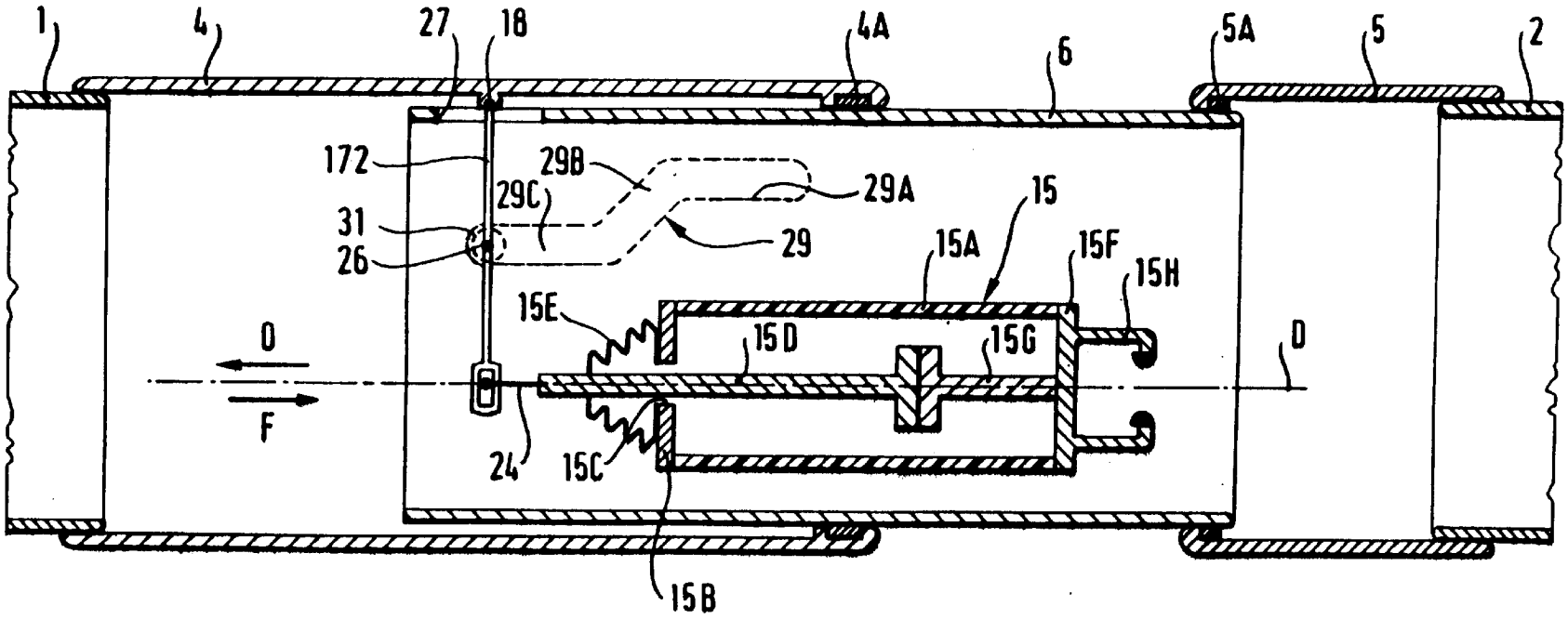
FIG. 2 is a diagrammatic longitudinal section view of a circuit breaker including a pair of grooves formed in the moving main contact and guiding two wheels.

FIG. 2 shows a second particular embodiment of the invention in which elements that are common with those of FIG. 1 are given the same references. A lever 172 is hinged at one of its ends to pivot about a pivot 18 connected to the fixed contact piece 4. A recess 27 is formed through the moving main contact 6 to allow the lever 172 to pass through without hindering movement of the moving main contact 6 in translation. The moving arcing contact 15D is secured to the lever 172 via a rigid rod 24.

One or two identical grooves 29 are formed in the thickness of the side surface of the moving main contact 6 and are disposed symmetrically about a midplane of the circuit breaker, as represented by the plane of FIG. 2. Each groove has two horizontal levels 29A and 29C, interconnected by respective sloping intermediate portions 29B.

A rigid rod 26 is disposed perpendicularly to the midplane of the circuit breaker and is rigidly connected to the lever 172.

Identical wheels 31 are carried at the two ends of the rigid rod 26 and are guided along the two grooves 29.

The above-described circuit operates as follows:

On opening, movement of the moving main contact 6 in translation in direction D along arrow O causes the wheels 51 to run along the grooves at horizontal level 29C. The lever 172 is not subjected to force from the moving main contact 6. It remains stationary, as does the moving arcing contact 15D.

The moving main contact 6 travels along a portion of its stroke corresponding to taking up a distance from the fixed main contact 5 that is sufficient, in air, to withstand a transient electrical voltage of the circuit breaker. Once this distance has been travelled, the wheels 31 reach the sloping intermediate portions 29D of the grooves 29. In this zone, they continue to travel along the grooves, but are caused to follow an angular path which, in turn, rotates the lever 172. Via the rigid rod 24, the lever 172 moves the moving arcing contact 15D quickly in translation, thereby separating it from the fixed arcing contact 15G.

When the moving main contact finishes off its opening stroke, the wheels 31 run along the grooves on the horizontal level 29A. The lever 172 remains stationary, as does the moving arcing contact 15D.

On closure, the moving main contact 6 moves in translation on direction D along arrow F, thereby causing the wheel 31 to run along the grooves on horizontal level 29A. The lever is not subjected to any force from the moving main contact 6 and remains stationary, as does the moving arcing contact 15D.

The wheels then engage the sloping intermediate portions 29B of the grooves 29. In this zone, they continue to run along the grooves, but they are subjected to angular displacement, thus rotating the lever 172 and causing the moving arcing contact 15D to move in rapid translation to close electrical contact with the fixing arcing contact 15G.

While the moving main contact 6 completes its closure stroke, the wheels 31 run along the grooves on horizontal level 29C, thereby enabling the moving main contact 6 to have a stroke that is longer than that of the moving arcing contact 15D. The lever 172 remains stationary, as does the moving arcing contact 15D.

In this particular embodiment, the circuit breaker has the advantage of determining the speed and the acceleration of the moving arcing contact 15D by means of the slope of the sloping intermediate portion 29B.

Figure 3:
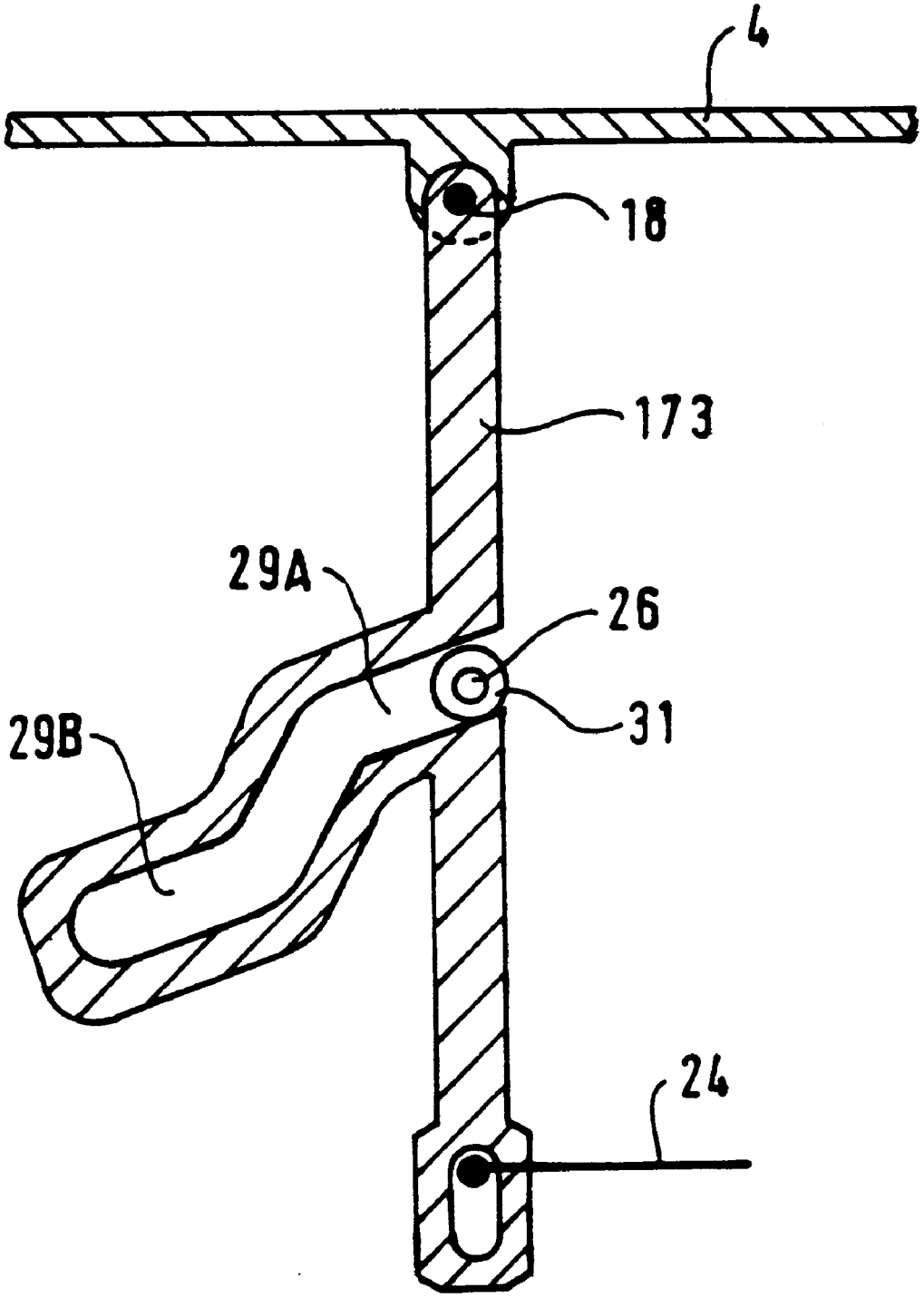
FIG. 3 is a diagram showing a variant of FIG. 2.

FIG. 3 shows a variant of the preceding embodiment in which the lever, now referenced 173, is folded and bent in an approximately central portion to define the groove 29. It should be understood that the fold in the lever defines the inside of the groove 29.

The connection in displacement between the moving main contact 6 and the lever 173 is provided by a wheel 31 mounted to rotate freely on the rigid rod 26 whose two ends are fixed to the moving main contact 6.

The operation of this circuit breaker in opening and in closing is analogous to that described with reference to the embodiment shown in FIG. 2.

In particular, the movement of the moving main contact 6 causes the moving arcing contact 15D to move by pivoting the lever 173 under drive from the wheel 31 running along a first portion 29A of the groove 29.

While the main contact 6 is finishing off its opening stroke, the wheel 31 runs along a second portion 29B of the groove 29 which occupies a level that is horizontal because of a change in the slope of the second portion 29B relative to the first portion 29A. In this way, the lever 173 and the moving arcing contact 15D remains stationary.

In this variant, the tube constituting the moving main contact 6 is of smaller weight, thereby making it possible to reduce control energy requirements.

We claim:

1. A generator circuit breaker comprising:

a fixed tubular main contact and a moving tubular main contact that moves relative to the fixed tubular main contact in a longitudinal direction, the main contacts defining a volume, wherein said fixed tubular main contact includes a fixed contact piece;

a vacuum or gas bottle disposed within said volume;

a fixed arcing contact and a moving arcing contact disposed in said bottle, wherein said moving arcing contact moves relative to the fixed arcing contact in said longitudinal direction;

synchronization means for separating the main contacts before the arcing contacts separate, wherein the synchronization means comprises:

a lever hinged at one of its ends to said fixed contact piece, said lever being connected to said moving main contact so as to move with the moving main contact and being connected to said moving arcing contact by a spring so as to move with the moving arcing contact;

a ramp having two horizontal levels interconnected by a sloping intermediate portion, wherein said ramp is connected to said lever; and a trigger member slidingly supported by said ramp, wherein said trigger member prevents the moving arcing contact from moving while said trigger member is sliding on one of the horizontal levels of the ramp, and releases the moving arcing contact to move by engaging the sloping intermediate portion and while sliding over the other horizontal level of the ramp.

2. A generator circuit breaker comprising:

a fixed tubular main contact and a moving tubular main contact that moves relative to the fixed tubular main contact in a longitudinal direction, the main contacts defining a volume, wherein said fixed tubular main contact includes a fixed contact piece, and wherein said moving tubular main contact includes a groove therein, said groove having two horizontal levels interconnected by a sloping intermediate portion;

a vacuum or gas bottle disposed within said volume;

a fixed arcing contact and a moving arcing contact disposed in said bottle, wherein said moving arcing contact moves relative to the fixed arcing contact in said longitudinal direction;

synchronization means for separating the main contacts before the arcing contacts separate, wherein the synchronization means comprises:

a lever hinged at one of its ends to said fixed contact piece, said lever being connected to said moving arcing contact so as to move with the moving arcing contact, and being connected to said moving main contact by a wheel connected to said lever, said wheel being guided in said groove so as to move with the moving main contact wherein movement of the moving main contact, when the wheel is guided by the inclined intermediate portion of the groove, results in movement of the moving arcing contact by pivoting the lever.

3. A generator circuit breaker comprising:

a fixed tubular main contact and a moving tubular main contact that moves relative to the fixed tubular main contact in a longitudinal direction, the main contacts defining a volume, wherein said fixed tubular main contact includes a fixed contact piece, and wherein said moving tubular main contact includes a wheel attached thereto;

a vacuum or gas bottle disposed within said volume;

a fixed arcing contact and a moving arcing contact disposed in said bottle, wherein said moving arcing contact moves relative to the fixed arcing contact in said longitudinal direction;

synchronization means for separating the main contacts before the arcing contacts separate, wherein the synchronization means comprises:

a lever hinged at one of its ends to said fixed contact piece and including a groove having two horizontal levels interconnected by a sloping intermediate portion, wherein said groove is constituted by an approximately central folded and bent portion of the lever;

said lever being connected to said moving arcing contact so as to move with the moving arcing contact, and being connected to said moving main contact by said groove which guides said wheel, said wheel being guided in said groove so as to move with the moving main contact wherein movement of the moving main contact, when the wheel is guided by the inclined intermediate portion of the groove, results in movement of the moving arcing contact by pivoting the lever.

4. A generator circuit breaker according to claim 1, further comprising:

a plane fixed to said fixed contact piece, said plane having a through hole therein, wherein said trigger member is connected to said plane and includes a retractable catch aligned with said through hole.

5. A generator circuit breaker according to claim 4, wherein said trigger member is connected to said plane by a spring.

6. A generator circuit breaker according to claim 4, wherein said retractable catch is connected to said trigger member by a spring.

7. A generator circuit breaker according to claim 1, wherein said moving main contact is connected to said fixed contact piece by a sliding contact member.

8. A generator circuit breaker according to claim 1, wherein said bottle is connected to said fixed contact piece.

9. A generator circuit breaker according to claim 2, wherein said bottle is connected to said fixed contact piece.

10. A generator circuit breaker according to claim 3, wherein said bottle is connected to said fixed contact piece.

11. A generator circuit breaker comprising:

a fixed tubular main contact and a moving tubular main contact that moves relative to the fixed tubular main contact in a longitudinal direction, the main contacts defining a volume, wherein said fixed tubular main contact includes a fixed contact piece;

a bottle, containing a vacuum or gas, disposed within said volume;

a fixed arcing contact and a moving arcing contact disposed in said bottle, wherein said moving arcing contact moves relative to the fixed arcing contact in said longitudinal direction;

a lever hinged at one of its ends to said fixed contact piece, said lever being connected to said moving main contact so as to move with the moving main contact, and being connected to said moving arcing contact by a spring so as to move with the moving arcing contact;

a ramp having two horizontal levels interconnected by a sloping intermediate portion, wherein said ramp is connected to said lever; and a trigger member slidingly supported by said ramp, wherein said trigger member prevents the moving arcing contact from moving while said trigger member is sliding on one of the horizontal levels of the ramp, and releases the moving arcing contact to move by engaging the sloping intermediate portion and while sliding over the other horizontal level of the ramp.

12. A generator circuit breaker comprising:

a fixed tubular main contact and a moving tubular main contact that moves relative to the fixed tubular main contact in a longitudinal direction, the main contacts defining a volume, wherein said fixed tubular main contact includes a fixed contact piece, and wherein said moving tubular main contact includes a groove therein, said groove having two horizontal levels interconnected by a sloping intermediate portion;

a bottle, containing a vacuum or gas, disposed within said volume;

a fixed arcing contact and a moving arcing contact disposed in said bottle, wherein said moving arcing contact moves relative to the fixed arcing contact in said longitudinal direction;

a lever hinged at one of its ends to said fixed contact piece said lever being connected to said moving arcing contact so as to move with the moving arcing contact, and being connected to said moving main contact by a wheel connected to said lever, said wheel being guided in said groove so as to move with the moving main contact wherein movement of the moving main contact, when the wheel is guided by the inclined intermediate portion of the groove, results in movement of the moving arcing contact by pivoting the lever.

* * * * *